US010478979B1

(12) United States Patent
James

(10) Patent No.: US 10,478,979 B1
(45) Date of Patent: Nov. 19, 2019

(54) SHEARS USEFUL FOR CUTTING HAIR

(71) Applicant: Taylor James, Lees Summit, MO (US)

(72) Inventor: Taylor James, Lees Summit, MO (US)

( * ) Notice: Subject to any disclaimer, the term of this patent is extended or adjusted under 35 U.S.C. 154(b) by 8 days.

(21) Appl. No.: 15/082,693

(22) Filed: Mar. 28, 2016

Related U.S. Application Data

(60) Provisional application No. 62/139,452, filed on Mar. 27, 2015, provisional application No. 62/236,112, filed on Oct. 1, 2015.

(51) Int. Cl.
*B26B 19/00* (2006.01)
*B26B 13/28* (2006.01)
*B26B 13/20* (2006.01)

(52) U.S. Cl.
CPC ..... *B26B 13/28* (2013.01); *B26B 13/20* (2013.01)

(58) Field of Classification Search
CPC ..... B26B 13/20; B26B 13/28; B26B 13/00; B26B 13/06; B26B 19/00; Y10T 29/49947; Y10T 403/75
USPC ..... 30/254, 232, 341, 256, 226, 230, 271, 30/257, 194, 195, 225
See application file for complete search history.

(56) References Cited

U.S. PATENT DOCUMENTS 192,426 A * 6/1877 Foltz et al. ..... A01G 3/025 30/251
1,533,039 A * 4/1925 Shirk ..... B26B 13/26 30/250
2,529,171 A * 11/1950 Menser ..... B23D 29/026 30/128
4,850,110 A * 7/1989 Meier, Jr. ..... B26B 13/24 30/135
5,722,171 A * 3/1998 Schmidt ..... B26B 13/12 30/255
5,860,215 A * 1/1999 Roskam ..... B26B 13/26 30/254
6,752,054 B2 * 6/2004 Knight ..... B26B 13/26 30/251
8,726,522 B2 * 5/2014 Lin ..... B26B 13/00 30/232
2004/0003501 A1 * 1/2004 Mikami ..... B26B 13/20 30/199
2004/0211068 A1 * 10/2004 Yusufov ..... B26B 13/00 30/232
2006/0010695 A1 * 1/2006 Wu ..... B26B 13/20 30/232

* cited by examiner

*Primary Examiner* — Ghassem Alie
(74) *Attorney, Agent, or Firm* — Stinson LLP

(57) ABSTRACT

An adjustable shears has a handle that can be adjusted to selectively re-configure the shears. The adjustable shears includes a first blade, a second blade pivotally connected to the first blade for pivoting movement of the blades about a first axis to accomplish a cutting motion of the blades. A first handle is connected to the first blade and a second handle is connected to the second blade. The second handle is configured for connection to the second blade in a plurality of distinct positions with respect to the second blade, at least some of the distinct positions being separated angularly from each other about a second axis parallel to the first axis.

6 Claims, 18 Drawing Sheets

SHEARS USEFUL FOR CUTTING HAIR

STATEMENT OF RELATED CASES

This application is a nonprovisional filing of U.S. Provisional Application Ser. No. 62/139,452, filed Mar. 27, 2015, and U.S. Provisional Application Ser. No. 62/236,112, filed Oct. 1, 2015, both of which are incorporated herein by reference in their entireties.

FIELD OF THE INVENTION

The present invention relates generally to shears, and more particularly to shears that are useful for cutting hair.

BACKGROUND

The users of these shears have a variety of different hand sizes and shapes. Multiple different shear designs are required to fit the wide range of user's hand sizes and shapes. Common users of shears of the type to which the invention relates are hair stylists who use shears to achieve different cuts of hair. A hair stylist may also require multiple different shears to execute a variety of different cutting techniques.

SUMMARY

In one aspect of the present invention, adjustable shears comprise a first blade and a second blade pivotally connected to the first blade for pivoting movement of the blades about a first axis to accomplish a cutting motion of the blades. A first handle is connected to the first blade and a second handle connected to the second blade. The second handle is configured for connection to the second blade in a plurality of distinct positions with respect to the second blade. At least some of the distinct positions are separated angularly from each other about a second axis parallel to the first axis.

In another aspect of the present invention, shears for cutting hair comprises a first blade and a second blade pivotally connected to the first blade for pivoting movement of the blades about a pivot axis to accomplish a cutting motion. A first handle is associated with the first blade and a second handle is associated with the second blade. The second handle comprises a thumb rest having an open construction permitting a thumb or finger engaging the arcuate thumb rest to be moved infinitely away from the second handle in a plane perpendicular to the pivot axis of the blades and passing through the thumb rest.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
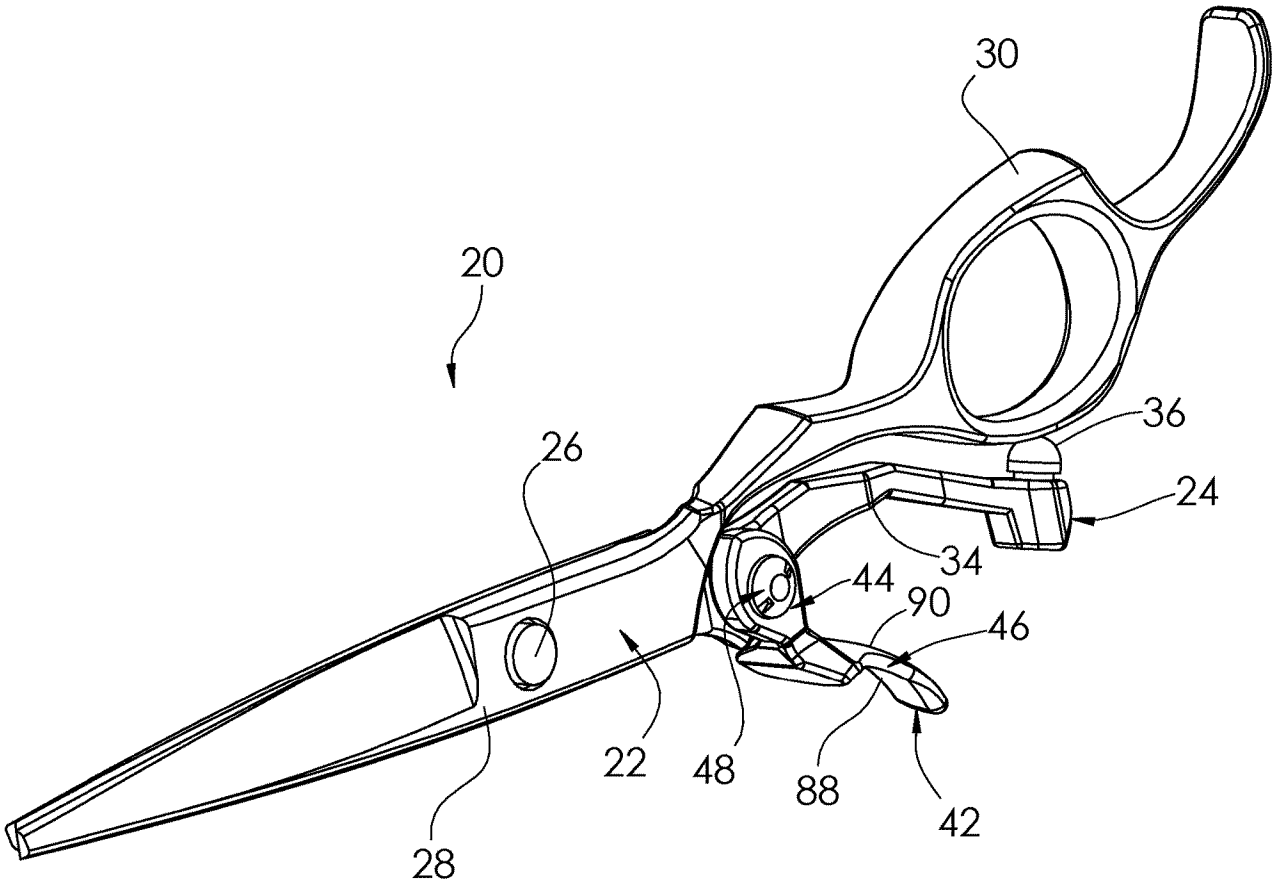
FIG. 1 is a perspective of adjustable shears of a first embodiment.

A cutting device or "shears" of a first embodiment of the present invention is shown in FIGS. 1-8, and indicated generally at 20. The shears of the illustrated embodiments are particularly useful in cutting hair, and more specifically human hair. The shears of this first embodiment includes a first blade 22 and a second blade 24 that are fastened together with a suitable fastener such as an adjustable fastener 26 that can permit the tightness with which the first and second blades are held together to be adjusted by the user. However, it will be understood that fasteners that do not permit adjustment could also be used. The first blade 22 includes a cutting portion 28 and a first handle 30 for gripping the first blade. As illustrated, the first handle 30 is formed as one piece of material with the cutting portion 28, but may be formed separately and attached to the cutting portion. The second blade 24 includes a cutting portion 32 and an extension portion 34 extending rearward of the cutting portion to a location next to the first handle 30. The extension portion 34 has a rubber tipped threaded stopper 36. The rubber tipped threaded stopper is a screw with a piece of rubber adhered or otherwise attached to the head of the screw. The stopper 36 is a standard part that is commercially available. This stopper 36 keeps the two blades from closing too far as well as allowing the blades to close together quietly. The stopper 36 may be fixed or adjustable to change the closed position. The stopper could be formed as one piece with the second blade (not shown). The extension portion 34 is formed as one piece of material with the remainder of the second blade 24. The first and second blades 22, 24 and first handle 30 may be formed from 440C stainless steel, although other materials may be used.

Figure 2:
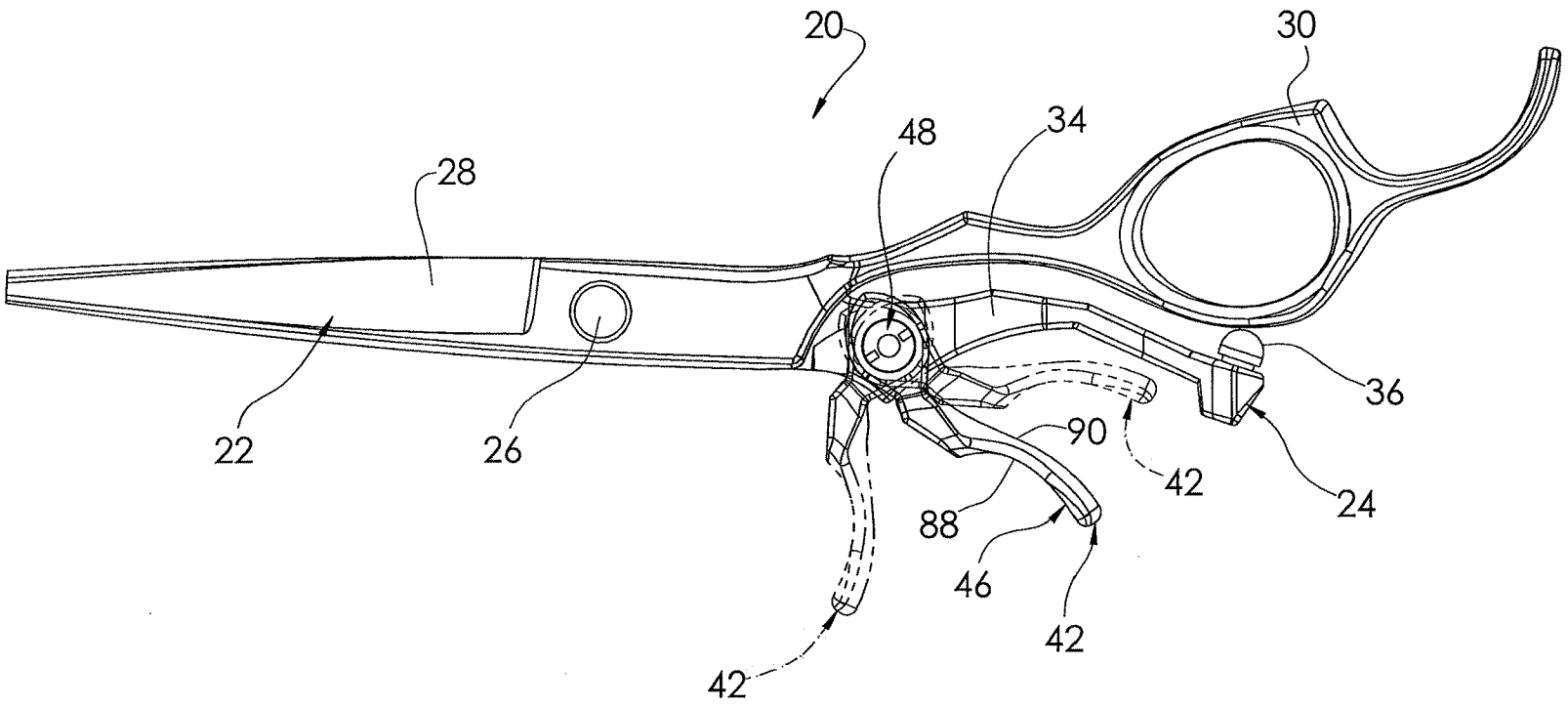
FIG. 2 is a side elevation of the adjustable shears illustrated adjusted positions of an adjustable handle.
Figure 3:
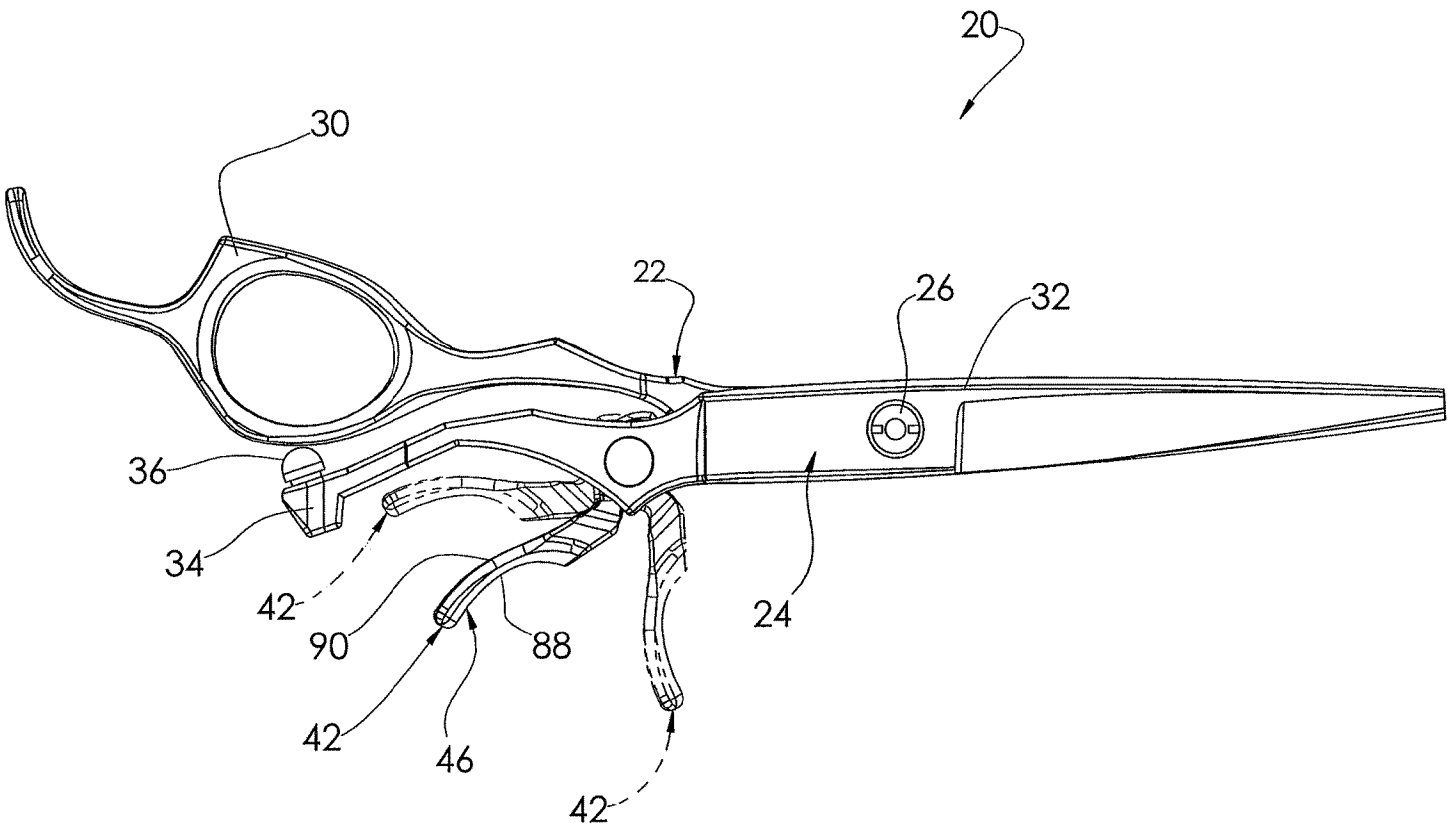
FIG. 3 is a side elevation similar to FIG. 2, but showing an opposite side of the adjustable shears.

A second handle 42 is attached to the second blade 24 in a manner which permits the second handle to be adjusted relative to the second blade. The second handle 42 is made of a suitable material, such as 440C stainless steel, and includes a mounting tab 44 and an arcuate portion 46 extending from the mounting tab. As may be seen in FIGS. 6 and 7, the mounting tab 44 is generally leaf-shaped, having its greatest width near its middle and tapering in width toward both ends. FIGS. 2 and 3 illustrate some of the positions to which the second handle 42 (broadly, "thumb rest") may be moved to for adjusting the configuration of the shears 20. The construction allows for a single pair of shears to be adjusted to properly fit a wide range of user's hand sizes, instead of having to find a different non-adjustable shears that fits each user properly. The adjustable handle 42 helps achieve the most preferable ergonomic feel for the user and allows them to achieve unique handle locations that are not available with other non-adjustable shears. This adjustability also allows for a user to change the rotary position of the second handle 42 during a cut to assist with changing from one cutting technique to a different cutting technique, instead of having to have different sets of shears for each technique. However, it is to be understood that the second handle may be fixed with respect to the second blade (not shown) within the scope of the present invention. For example, the second handle could be formed as one piece of material with the second blade.

Figure 4B:
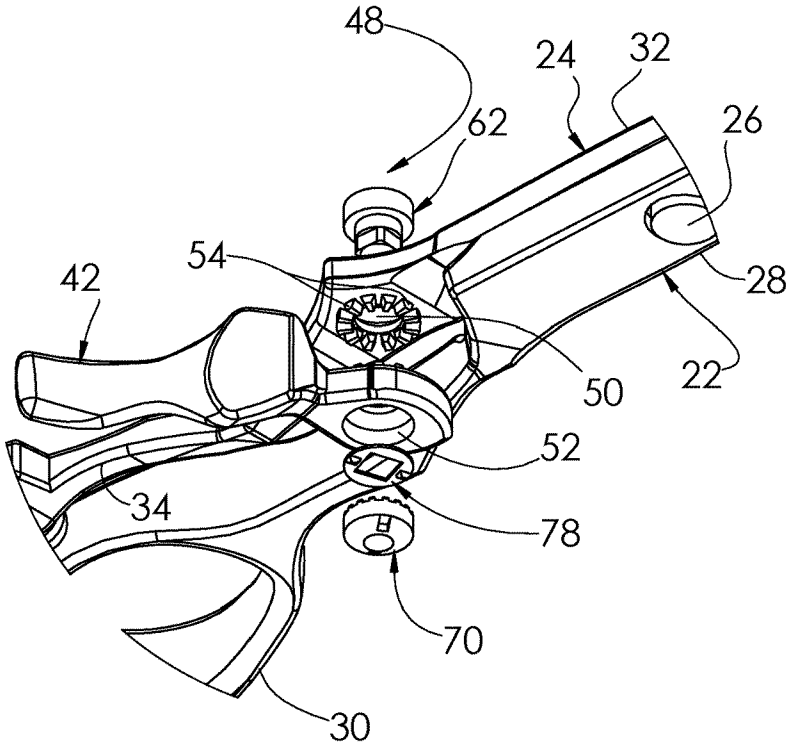
FIGS. 4A and 4B are enlarged, top and bottom side (respectively) fragmentary perspectives of the adjustable shears with the adjustable handle and a fastener assembly exploded from the remainder of the shears.
Figure 4A:
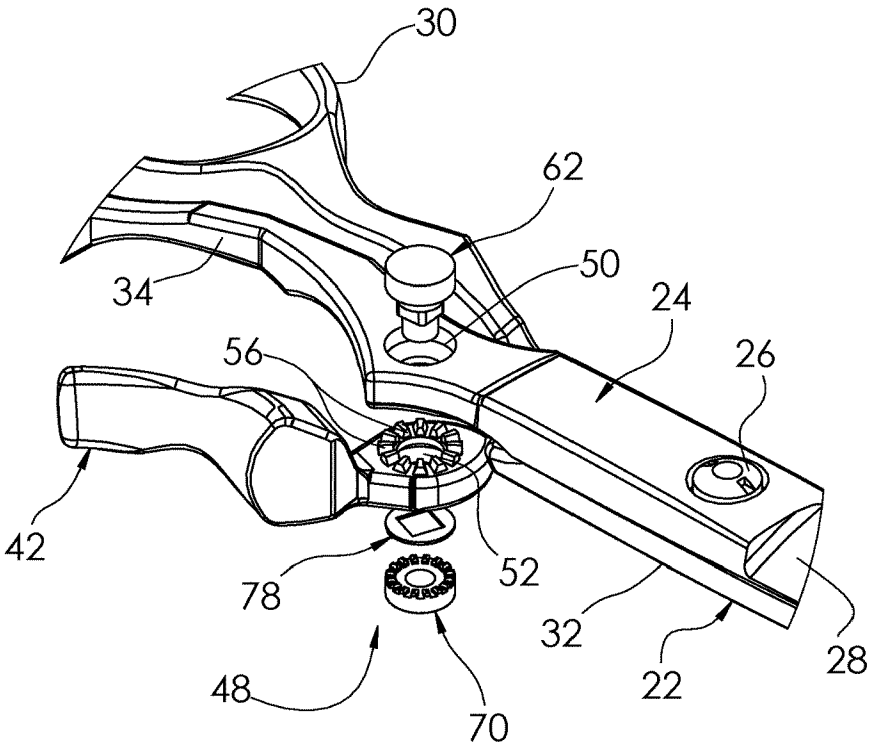
Figure 5:
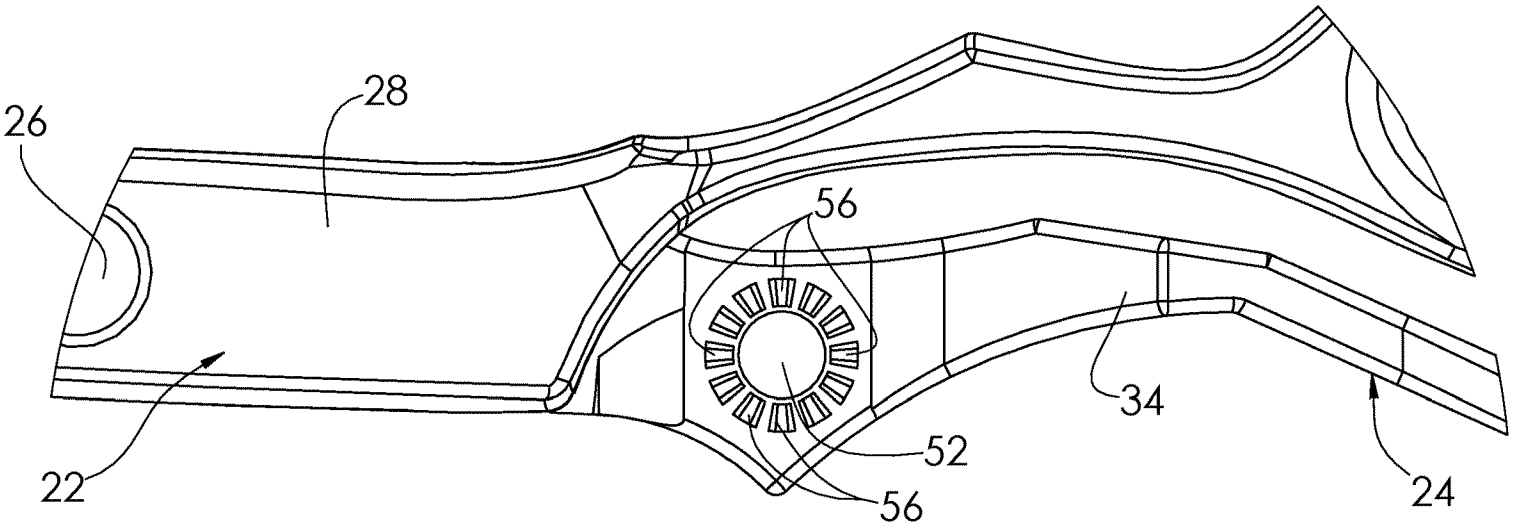
FIG. 5 is an enlarged, fragmentary elevation of the adjustable shears with the adjustable handle and fastener assembly removed.
Figure 6:
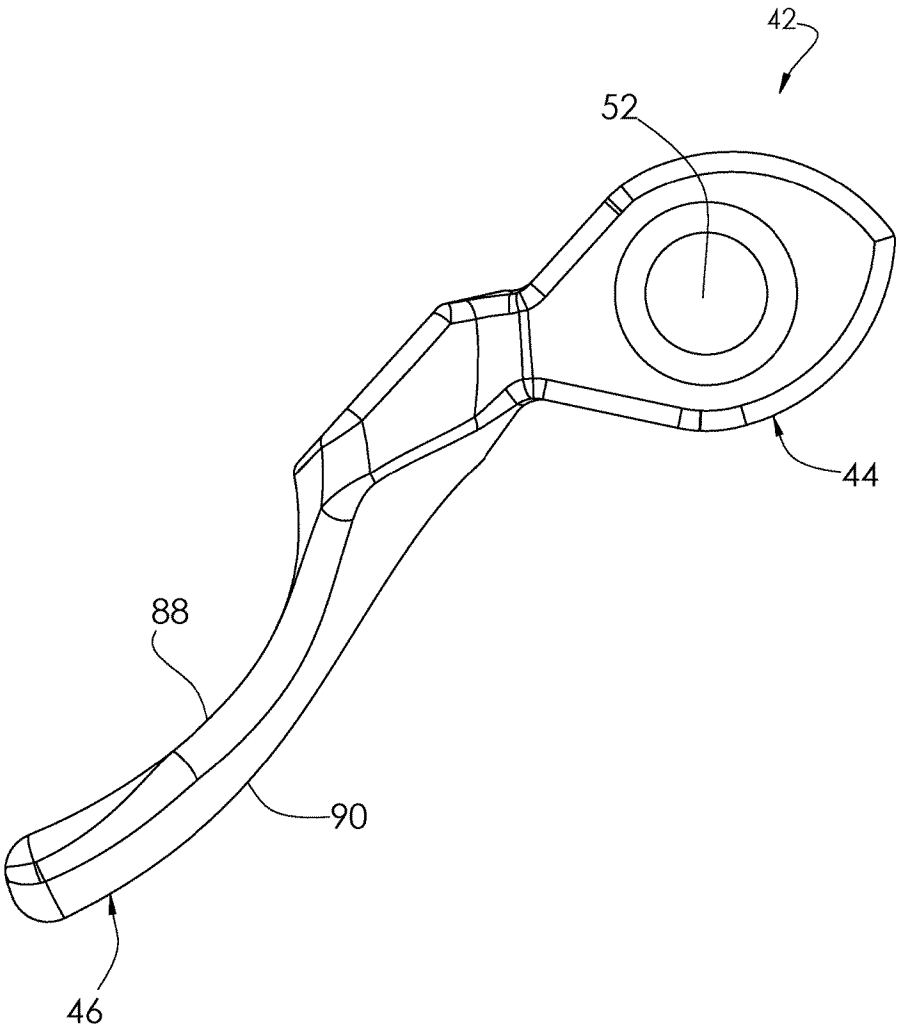
FIG. 6 is an enlarged elevation of a front side of the adjustable handle.
Figure 7:
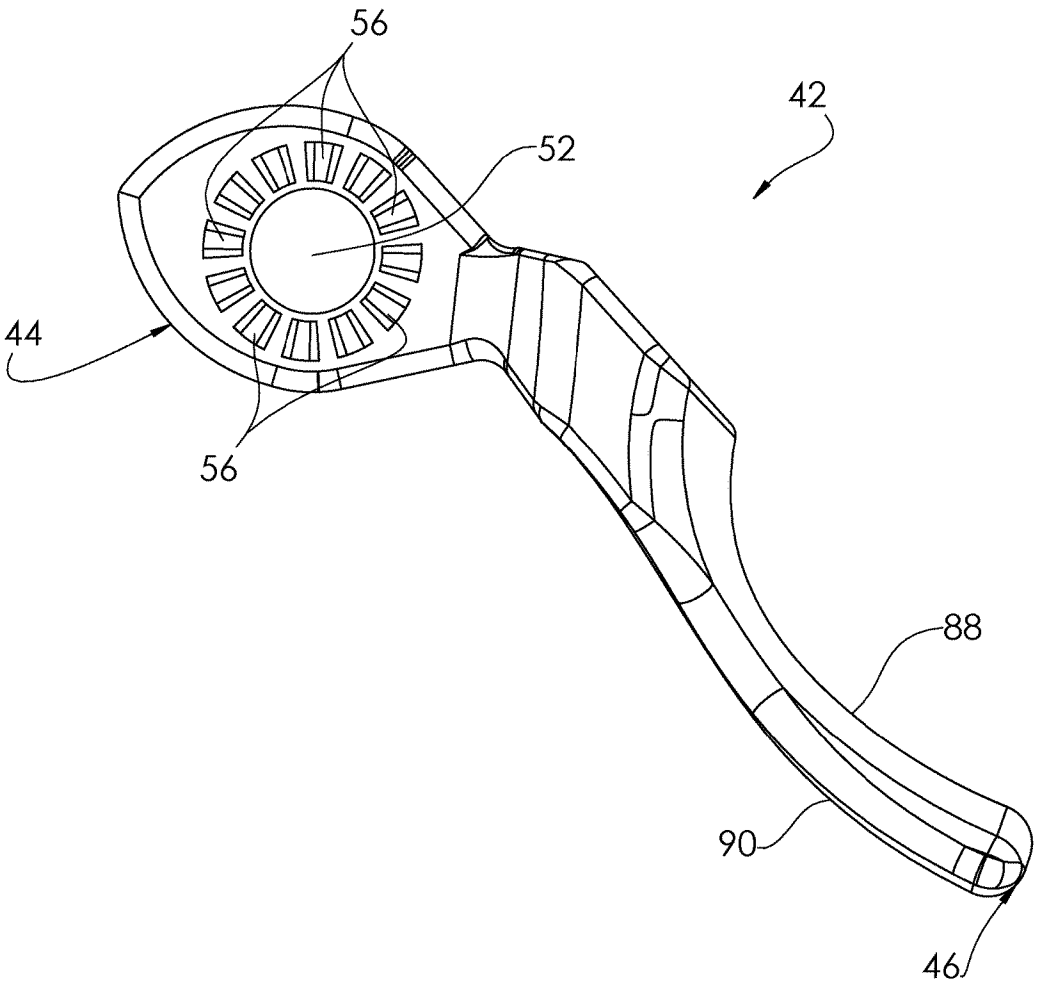
FIG. 7 is an enlarged elevation of a back side of the adjustable handle.

Referring to FIGS. 2, 4A and 4B, the second handle 42 can be selectively loosened or released from its connection to the second blade 24 to permit adjustment of the second handle. The second handle 42 is connected to the second blade 24 by a fastener assembly 48 (see also, FIG. 8) that extends through a countersunk hole 50 in the second blade 24 and a corresponding countersunk hole 52 in the mounting tab 44 of the second handle. The second blade 24 has a circular array of locking teeth 54 formed on an inner side of the second blade around the hole 50 (FIG. 4B). The second handle 42 has a corresponding circular array of locking teeth 56 formed on an opposing inner surface around the hole 52 (FIGS. 4A and 7). Both arrays of locking teeth 54, 56 may be broadly understood to be one embodiment of "locking structure." The locking teeth 54 of the second blade 24 interlock with the locking teeth 56 of the second handle 42 when they are brought together. The locking teeth 54, 56 each taper from their intersection with the second blade 24 or second handle 42 toward its free end to facilitating interengagement of the locking teeth with each other. In cross section, the locking teeth 54, 56 each have a roughly triangular shape; however there is a small flat surface at the top of each tooth. It will be understood that the second handle 42 may assume a plurality of different rotational positions with respect to the second blade 24, some of which are illustrated in FIGS. 2 and 3. As interengaged and held together by fastener assembly 48, the locking teeth 54, 56 prevent relative rotation between the second handle 42 and the second blade 24. Thus, once locked with the second blade, the second handle 42 and second blade move conjointly for use in actuating a cutting motion of the first and second blades 22, 24. It will be understood that other locking structures (not shown) for allowing the second handle to be releasably locked in multiple positions may be used within the scope of the present invention. For example, high friction material on the second blade and/or second handle could be used to permit essentially infinite adjustment of the rotary position of the second handle relative to the second blade.

Figure 8:
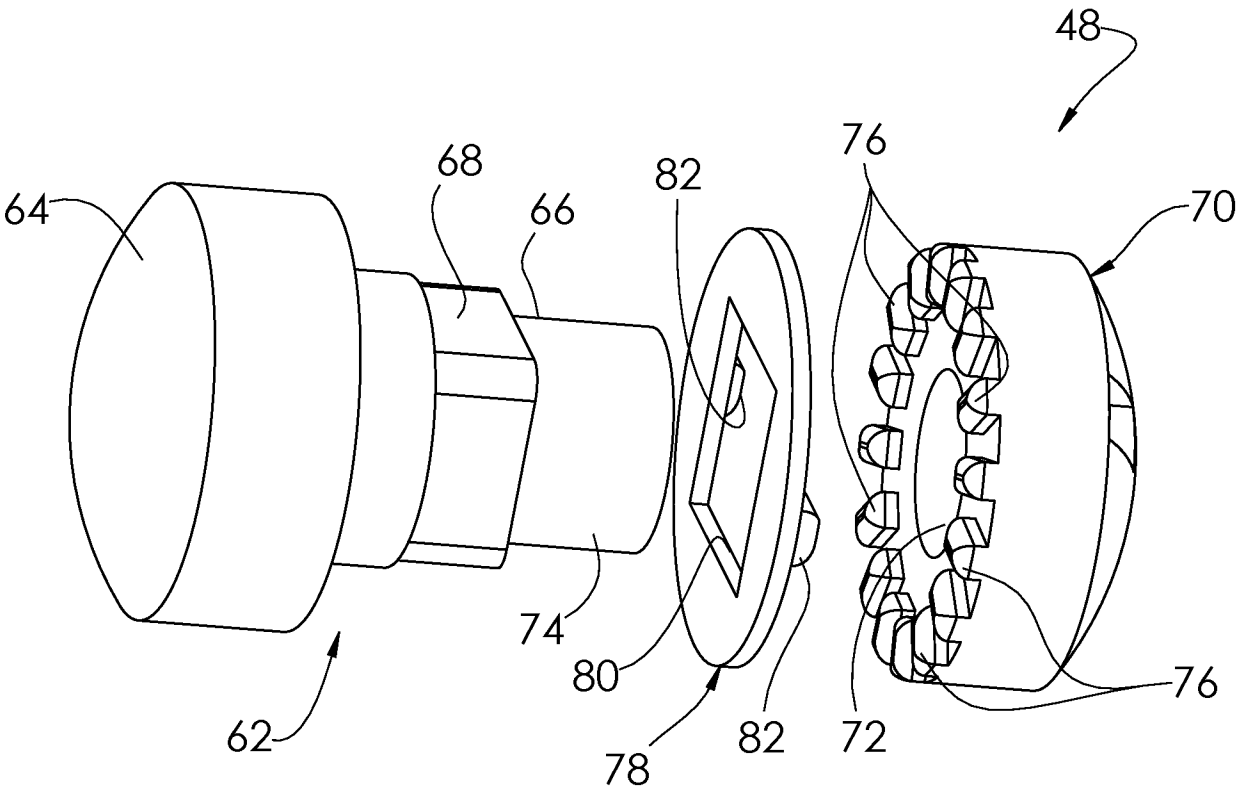
FIG. 8 is an exploded perspective of the fastener assembly.
Figure 9:
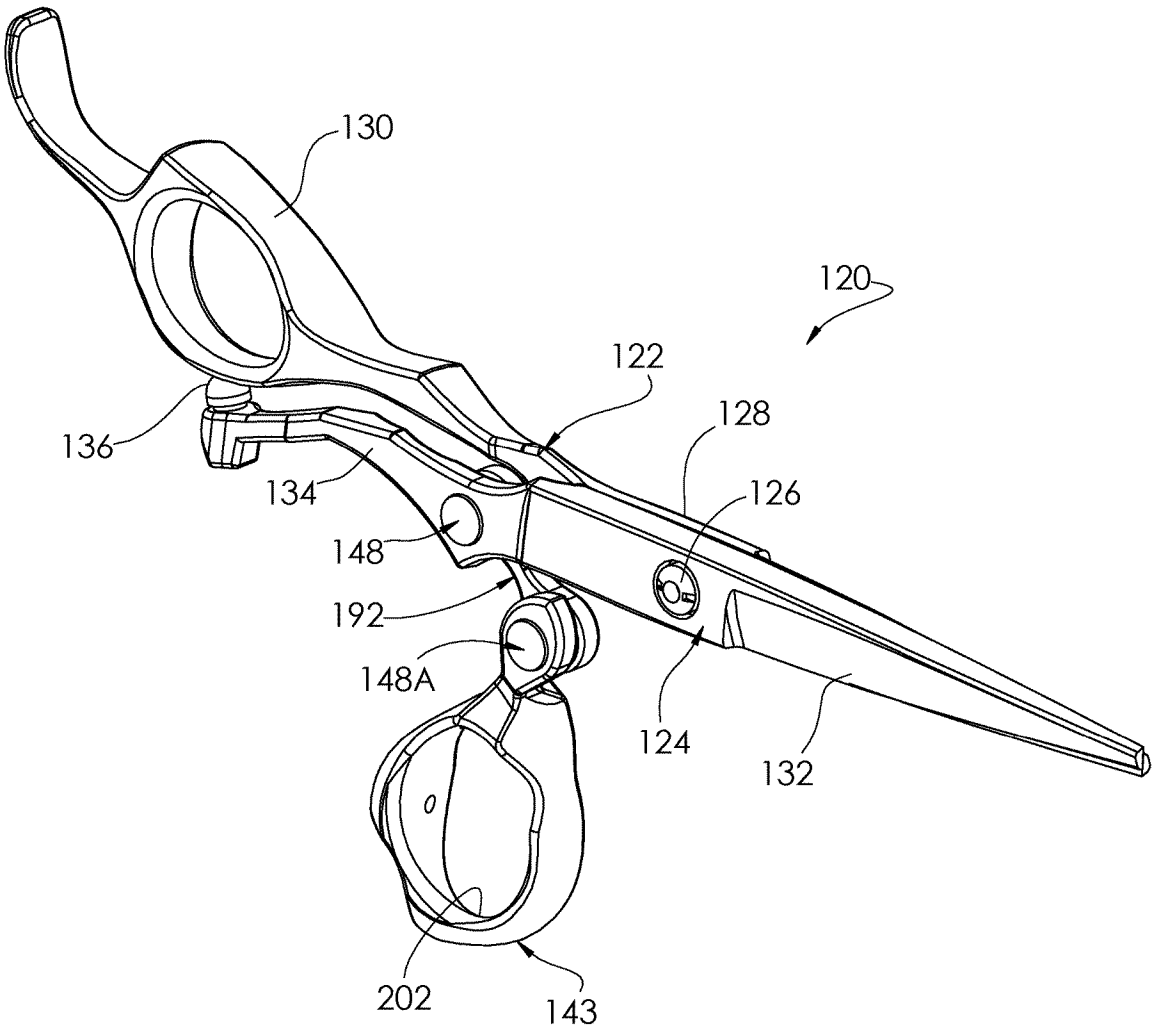
FIG. 9 is a perspective of adjustable shears of a second embodiment.

In the illustrated embodiment, the fastener assembly 48 is a commercially available locking screw and nut, and is illustrated at FIG. 8. The fastener assembly 48 used in the adjustable interconnection of the second handle 42 with the second blade 24 is either going to be locked down as tightly as possible to lock the handle in place or will be loosened enough to disengage the locking teeth. The fastener assembly 48 includes a screw 62 having a head 64 and a shaft 66 extending from the head. The shaft 66 of the screw 62 has different shapes and sizes, including a square portion 68. The screw 62 can be releasably secured to a nut 70 that has a central opening 72 to receive a threaded portion 74 of the screw shaft 66, and locking teeth 76 located on an interior face of the nut. A small washer piece 78 of the fastener assembly 48 is located between the screw head 64 and the nut 70. The washer piece 78 has a square opening 80 that receives the square portion 68 of the screw shaft 66. The washer piece 78 also has two dimples 82 formed into it which mesh with the locking teeth 76 on the nut 70 of the fastener assembly 48. Thus, the washer piece 78 and the screw 62 resist rotation relative to the nut 70 when the square portion 68 of the shaft 66 is received in the square opening 80 of the washer piece and the dimples 82 of the washer piece are held between adjacent locking teeth 76 of the nut. However, by loosening the fastener assembly 48 and application of sufficient force, the nut can be adjusted one click at a time. When in place, the fastener assembly 48 is then re-tightened. It is envisioned that a fastener assembly (not shown) that does not have to be loosened for adjustment may also be employed. As used in this application fastener "assembly" 48 includes both a collection of components such as described in this paragraph, or a single, unitary fastener (not shown).

The arcuate portion 46 of the second handle 42 is sized and shaped for receiving and retaining against slipping a thumb (or finger) of the technician. It will be understood that "thumb" and "finger" are used interchangeably in this description. Reference to one in this description is intended to convey reference to either the thumb or finger. However, it is preferred that the second handle 42 be used by the thumb and not the other fingers. In that regard, the second handle 42 is positioned closer to the cutting portion 32 of the second blade 24 than the first handle 30 is positioned to the cutting portion of the first blade 22. Stated another way, if the end of the shears 20 opposite the end where the first and second handles 30, 42 are located is considered the front end of the shears, the second handle is located forward of the first handle. In the illustrated embodiment, the arcuate portion 46 has the shape of a segment of a cylinder, including a concave surface 88 for receiving the thumb or finger, and an opposite, convex surface 90. The concave surface 88 is shallow. This provides structure for retaining the grip of the thumb on the arcuate portion 46, while providing minimal obstruction to movement of the thumb onto and off of the arcuate portion in use. The mounting tab 44 extends from the convex surface 90 of the arcuate portion 46. The mounting tab 44 and arcuate portion 46 are formed as one piece of material. It will be understood that they may be formed separately and attached together. The second handle 42 is in the illustrated embodiment free of any other structure for receiving a thumb or finger. In one technique, the thumb is received on the concave surface 88 of the arcuate portion 46 to hold the thumb in place on the second handle 42. In another technique, the thumb is received between the second handle 42 and the convex surface 90 of the arcuate portion 46. In that case, force applied to the convex surface 90 of the arcuate portion 46 by the thumb facilitates driving the cutting motion of the first and second blades 22, 24. The curvature of the convex surface 90 of the arcuate portion 46 together with the mounting tab 44 provides a recess that can receive the top of the thumb to help hold it from slipping off of the second handle 42 while cutting.

The second handle does not form a closed shape with itself or with the rear portion of the second blade 24 so that the thumb may be quickly and easily moved into and out of engagement with the second handle 42 and/or extension portion 34 of the second blade to manipulate the shears 20, such as while cutting hair. Stated another way, the thumb (or finger) engaging the concave surface 88 (or convex surface 90) of the arcuate portion 46 of the second handle 42 can be moved infinitely away from the arcuate portion in a plane that is perpendicular intersecting the arcuate portion 46 and to a pivot axis about which the first and second blades 22, 24 pivot to produce the cutting motion of the shears 20. The thumb may be moved in this plane without obstruction from the second handle 42, or from any other part of the shears. As a result, the thumb may engage and disengage the second handle 42 very quickly in use. This allows for much easier use of other tools, such as a comb, for example. For example, the construction of the shears 20 and specifically the second handle 42 facilitates the technician holding a comb in the same hand as the shears in use. Moreover, the greatly simplified construction of the second handle 42 contributes to making the shears 20 lightweight and easier to for the technician to handle. In a preferred embodiment, and as shown in the drawings, the second handle 42 is free of any other structure for holding a finger or thumb in place. For example, the second handle does not include a second, closed loop.

Adjustment of the relative position of the second handle 42 may accommodate the particular technician's hand size and need to feel control over the shears 20. A tighter fit will be present if the second handle 42 is adjusted to be closer to the extension portion 34 of the second blade 24. Depending upon the technician, the tighter fit may be desired for more control. However, a looser fit (corresponding to adjustment of the second handle 42 farther away from the extension portion 34 of the second blade 24) permits greater freedom in manipulating the shears 20. This same adjustment accommodates different hand and thumb sizes.

Referring now to FIGS. 9-18, adjustable shears of a second embodiment is generally indicated at 120. Parts of the shears 120 corresponding to parts of the shears 20 of the first embodiment will be given the same reference numeral, plus "100". The common parts will not be described again in detail, reference being made to the description of those parts for the shears 20. For example, the adjustable shears 120 includes a first blade 122 including a first handle 130, which as illustrated have the same construction as the first handle 22 and first blade 30 of the first embodiment. The adjustable shears 120 further comprises a second blade 124 which as illustrated has the same construction as the second blade 24 of the first embodiment. The first and second blades 122, 124 are connected together by a fastener 126 that permits them to be pivoted for achieving a cutting motion of the shears. A second handle 143 associated with the second blade 124 differs from the second handle 42 of the first embodiment, as does the construction by which the second handle is adjustably attached to the second blade. More specifically, the second handle 143 is connected by a link 192 to the second blade 124. As will be described more fully hereinafter, the second handle 143 is adjustably attached to one end of the link 192 and the link is adjustably attached to the second blade 124 at its other end.

Figure 10:
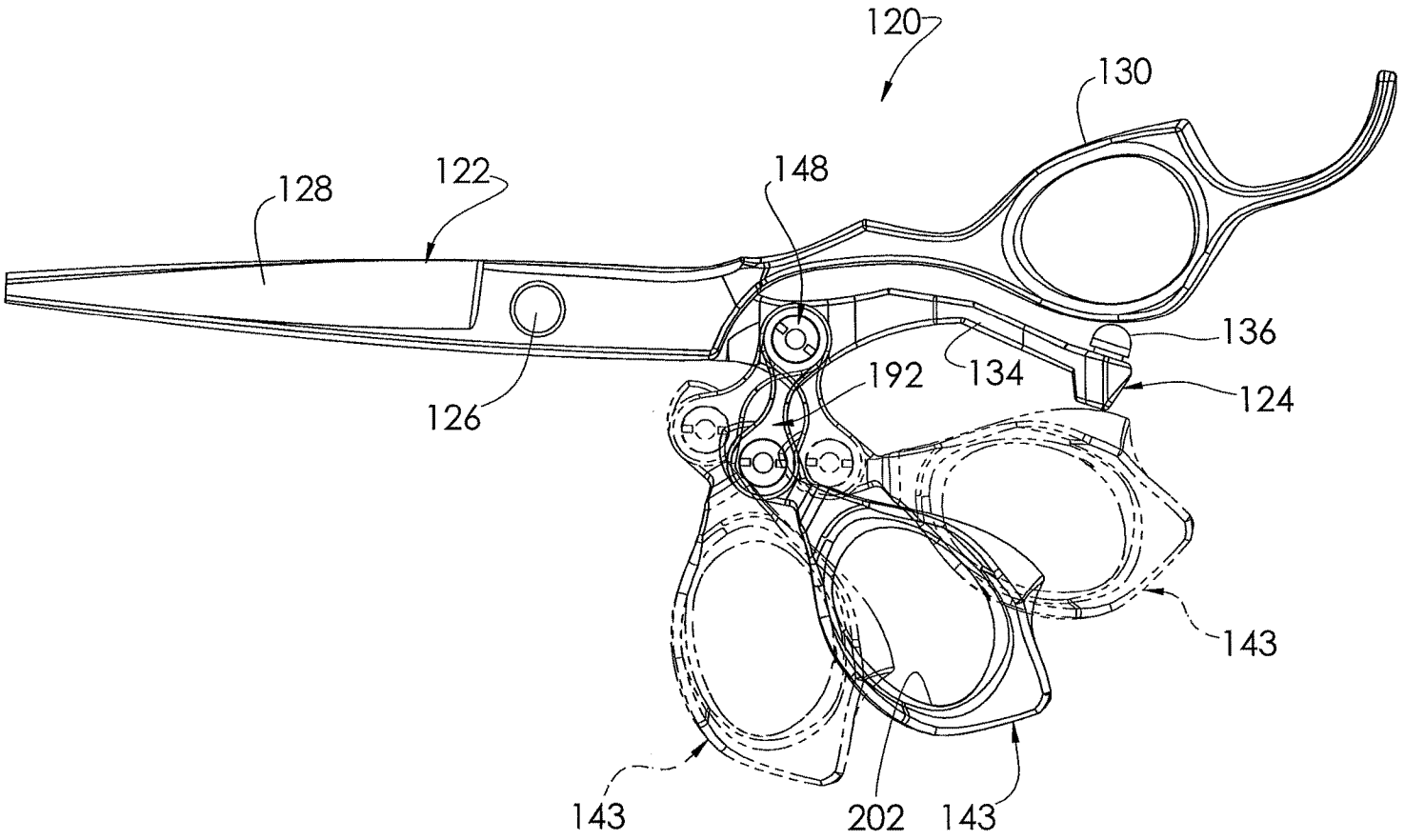
FIG. 10 is a side elevation of the adjustable shears of FIG. 9 illustrating adjusted positions of a link of the adjustable shears.

In the illustrated embodiment, the link 192 is a straight piece of 440C stainless steel that has fastener assembly 148, 148A at each end. The link 192 may be any shape and can be made of different materials, as long as it has structure that can be fastened to the second blade 124 and second handle 143. The link 192 acts as a moveable or adjustable connection between the second handle 143 and the second blade 124 for selectively changing their relative orientations. In a first instance, the rotational position of the link 192 can be selectively changed with respect to the second blade 124. Locking structure on the link 192 used for connection with the second blade 124 comprises a hole 194 for a fastener assembly 148 to fit through for connecting the link to the second blade. The locking structure further comprises on one side of the link 192 a circular array of locking teeth 196 surrounding the hole 194 (e.g., see FIG. 18). These teeth 196 are closely similar to the locking teeth 54, 56 described above and have triangular shaped protrusions from the face of the link 192 that have flats at the top. The locking teeth 196 mesh with a similar array of locking teeth 154 surrounding hole 150 in the second blade 124 that are part of a locking structure associated with the second blade. When the fastener assembly 148 holds the link 192 tightly against the second blade 124, the link moves conjointly with the second blade. The fastener assembly 148 may be loosened to permit separation of the locking teeth 196 of the link 192 from the locking teeth 154 of the second blade 124 (see, FIG. 12) to allow the link to pivot with respect to the second blade. Rotational adjustment of the link 192 with respect to the second handle 143 is illustrated in FIG. 10.

Figure 11:
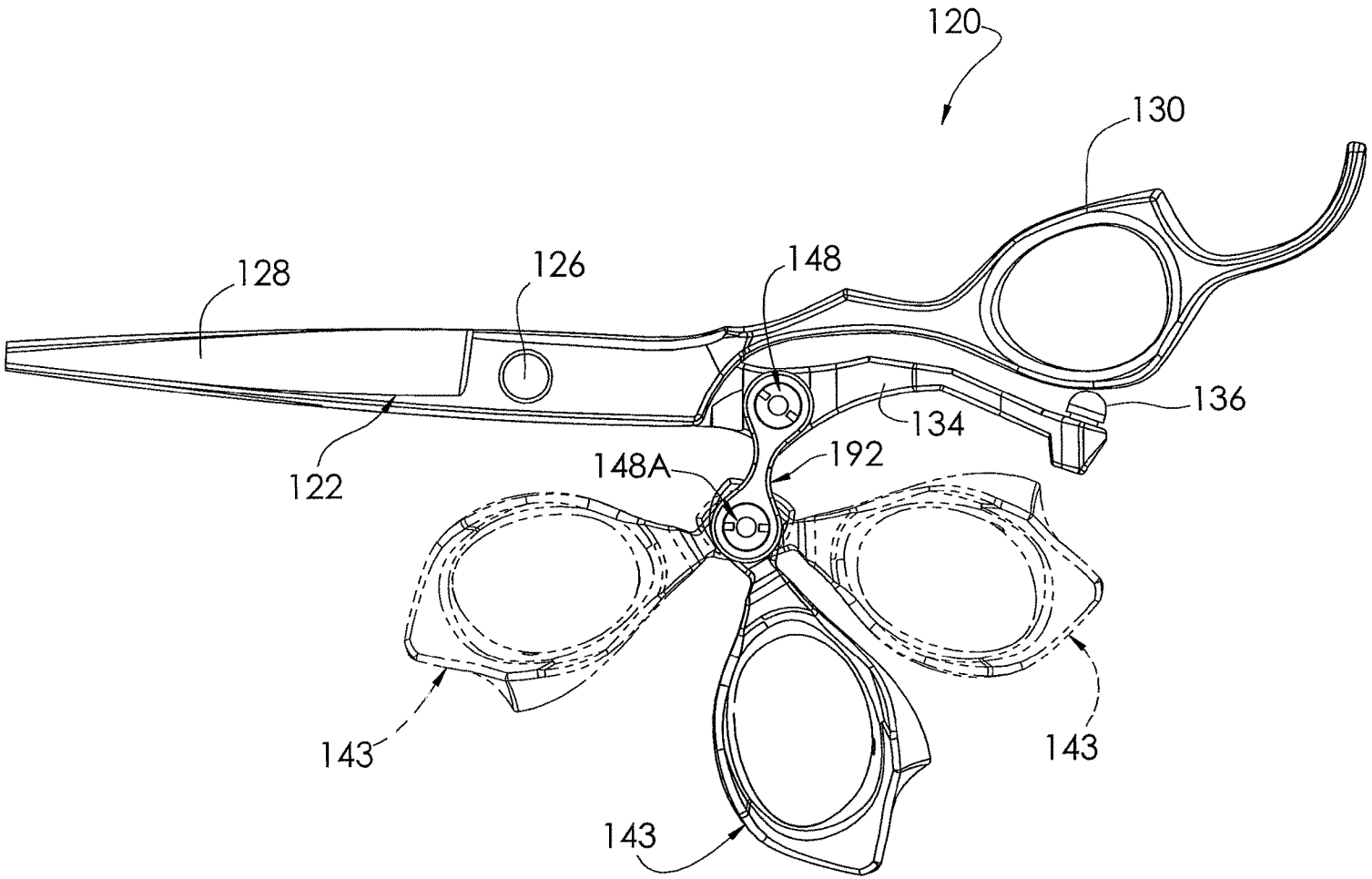
FIG. 11 is the side elevation of FIG. 10, but illustrating adjusted positions of an adjustable handle relative to the link.
Figure 12:
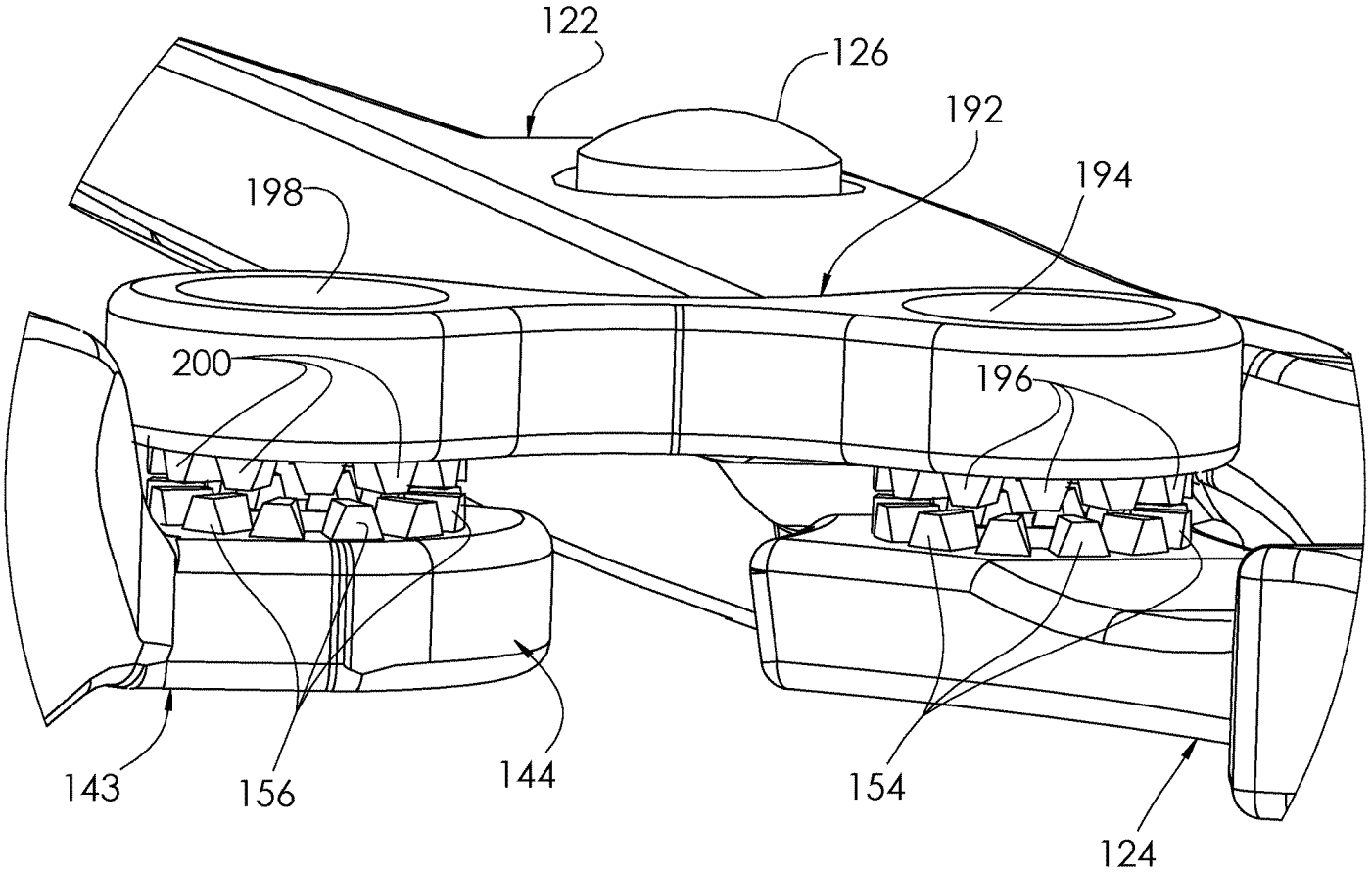
FIG. 12 is an enlarged, fragmentary top view of the adjustable shears of FIG. 9 showing the link separated from a blade and the adjustable handle of the shears.
Figure 13:
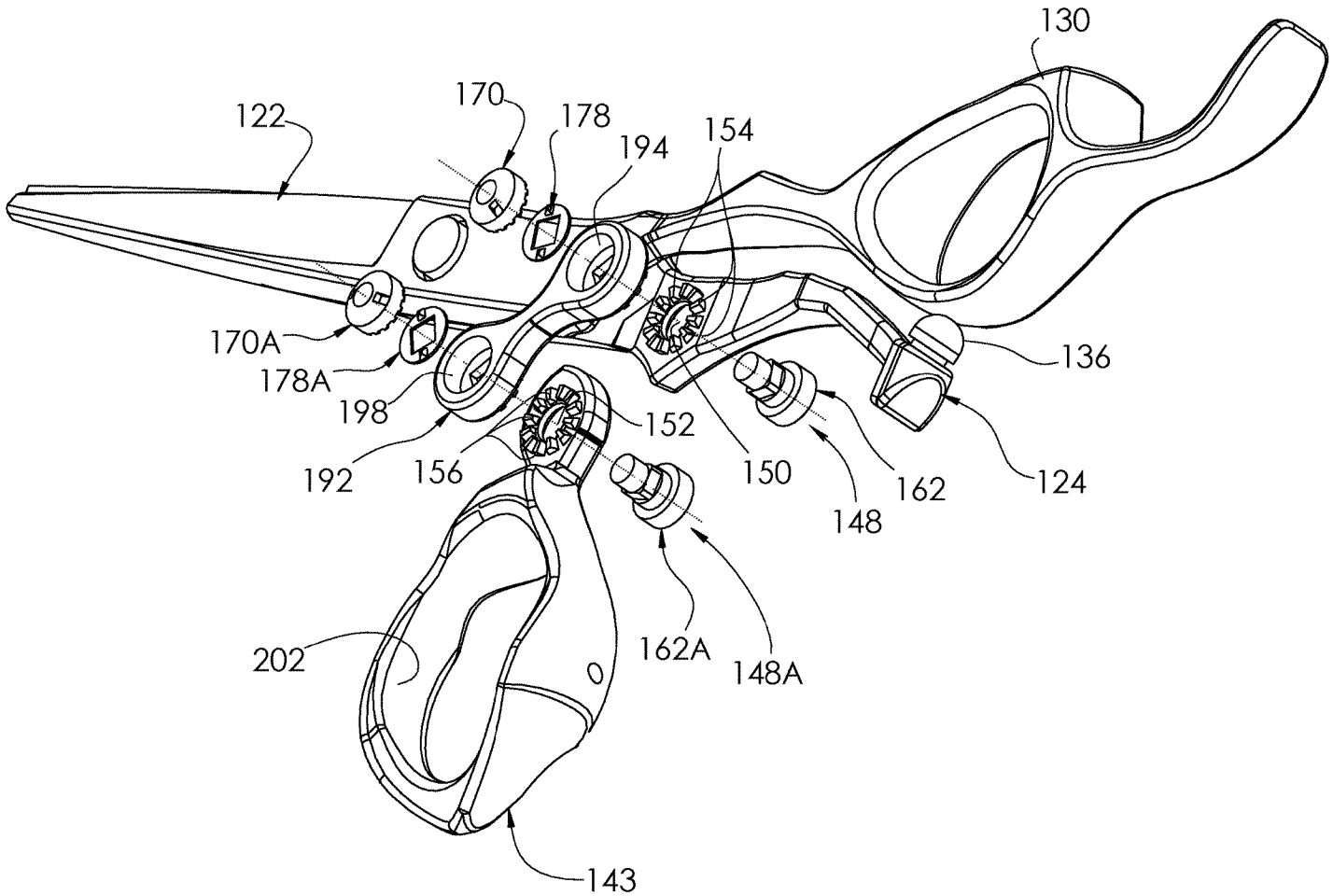
FIG. 13 is the perspective of FIG. 9, but showing the adjustable handle, link and fastener assembly exploded from the blades of the shears.
Figure 14:
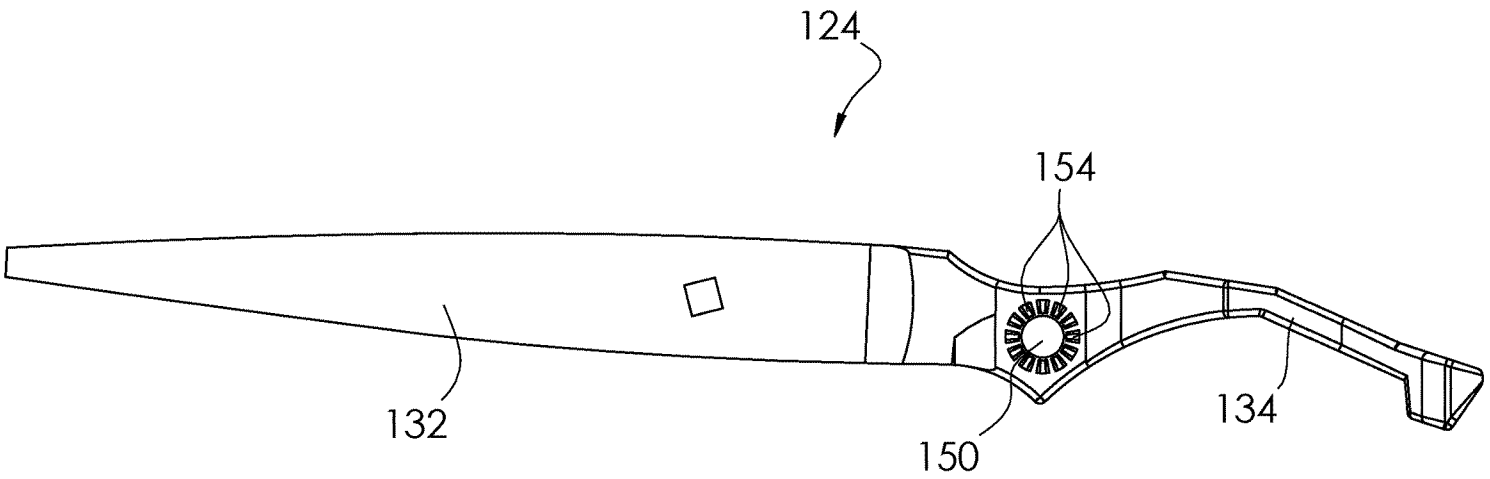
FIG. 14 is an elevation of one of the blades of the shears of FIG. 9 to which the adjustable handle is attached by the link.
Figure 15:
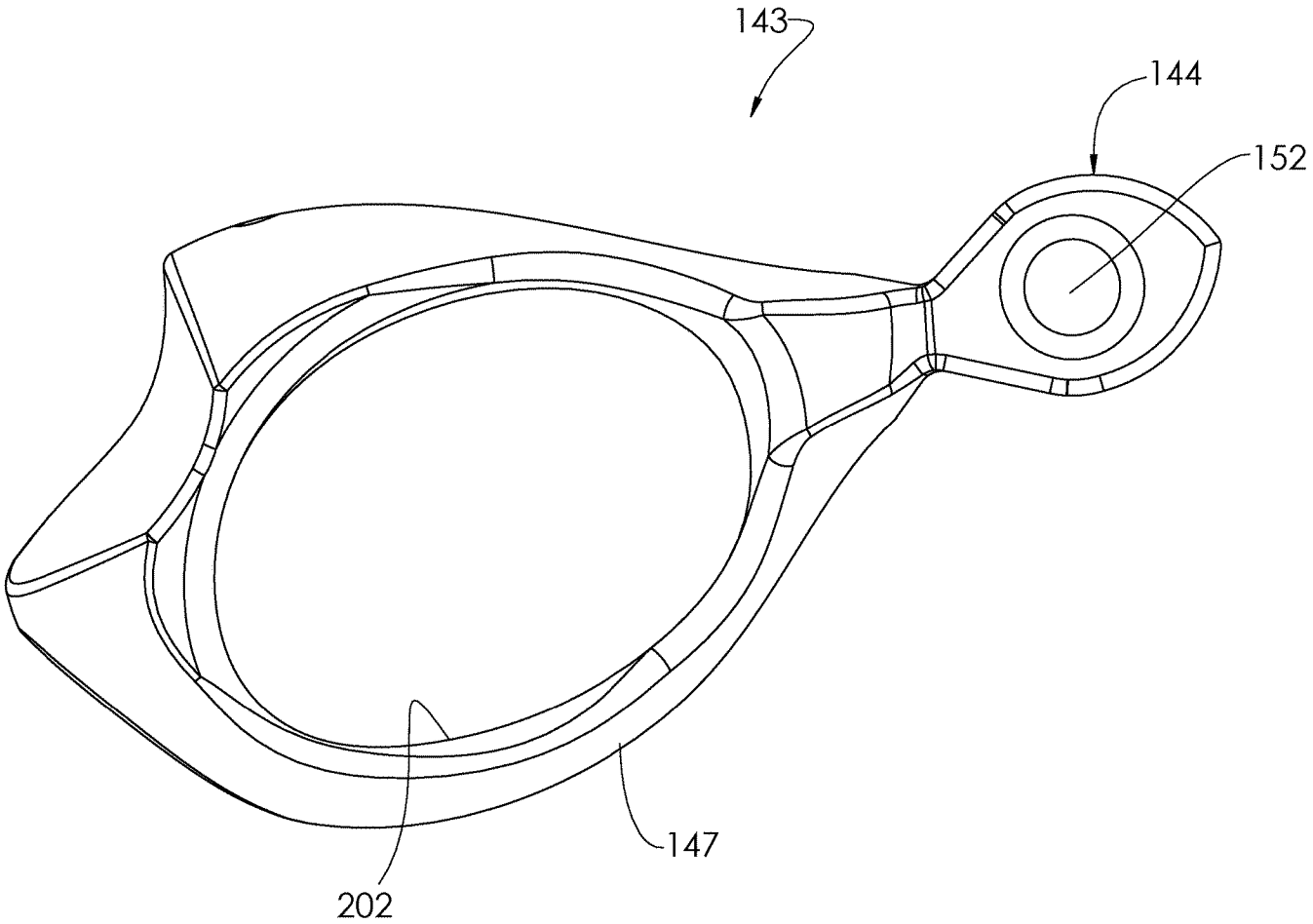
FIG. 15 is an enlarged front elevation of the adjustable handle of the shears of FIG. 9.
Figure 16:
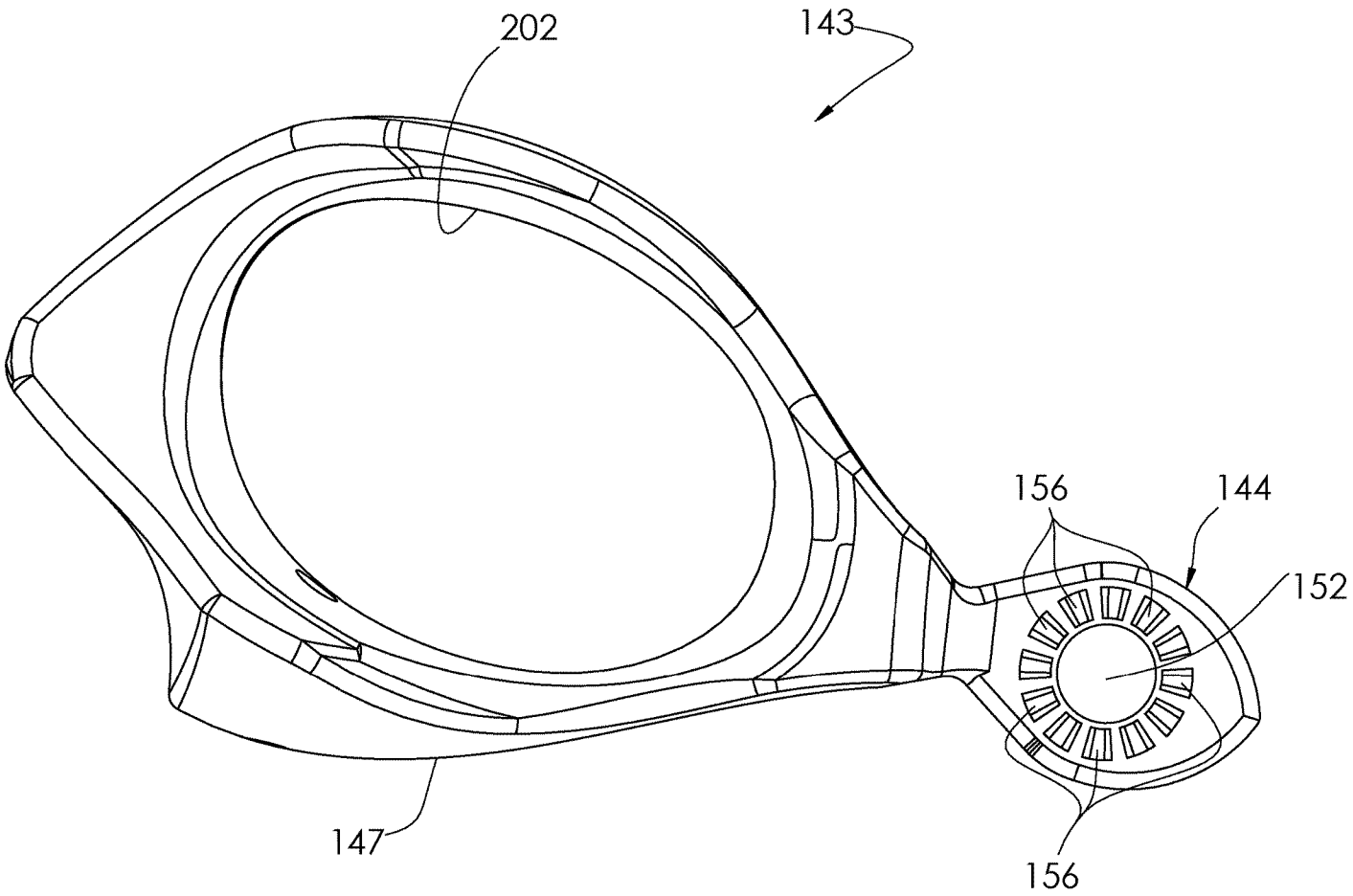
FIG. 16 is an enlarged rear elevation of the adjustable handle of the shears of FIG. 9.
Figure 17:
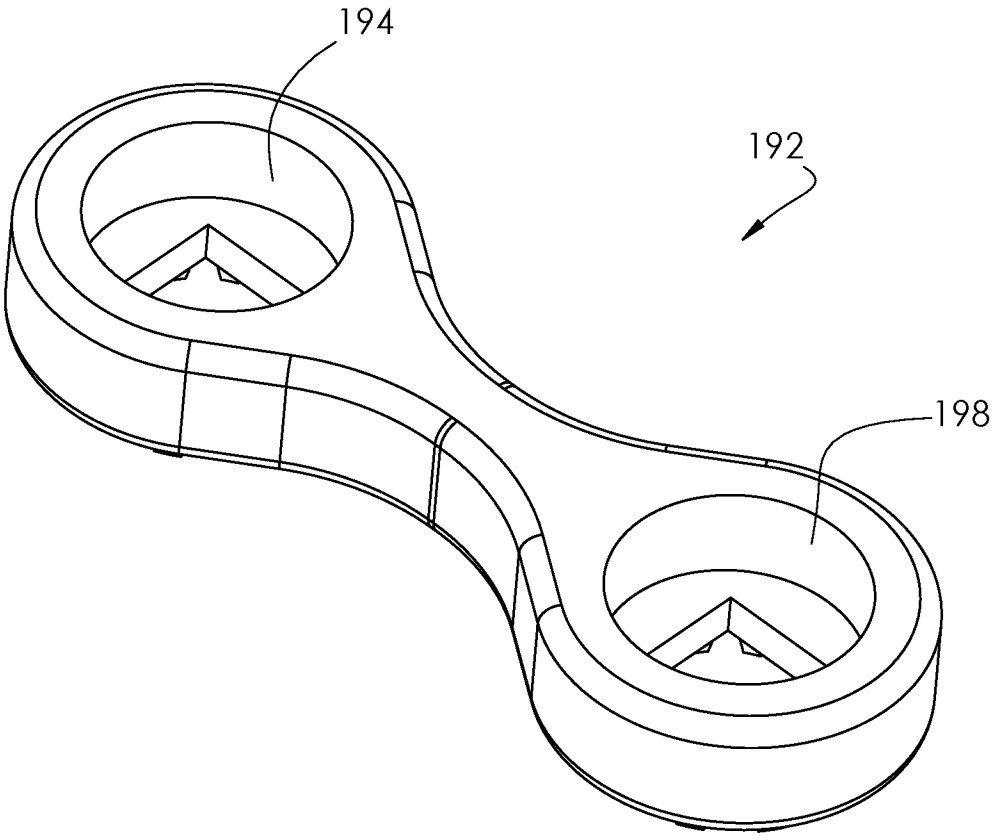
FIG. 17 is a perspective of the link from a front side of the link.
Figure 18:
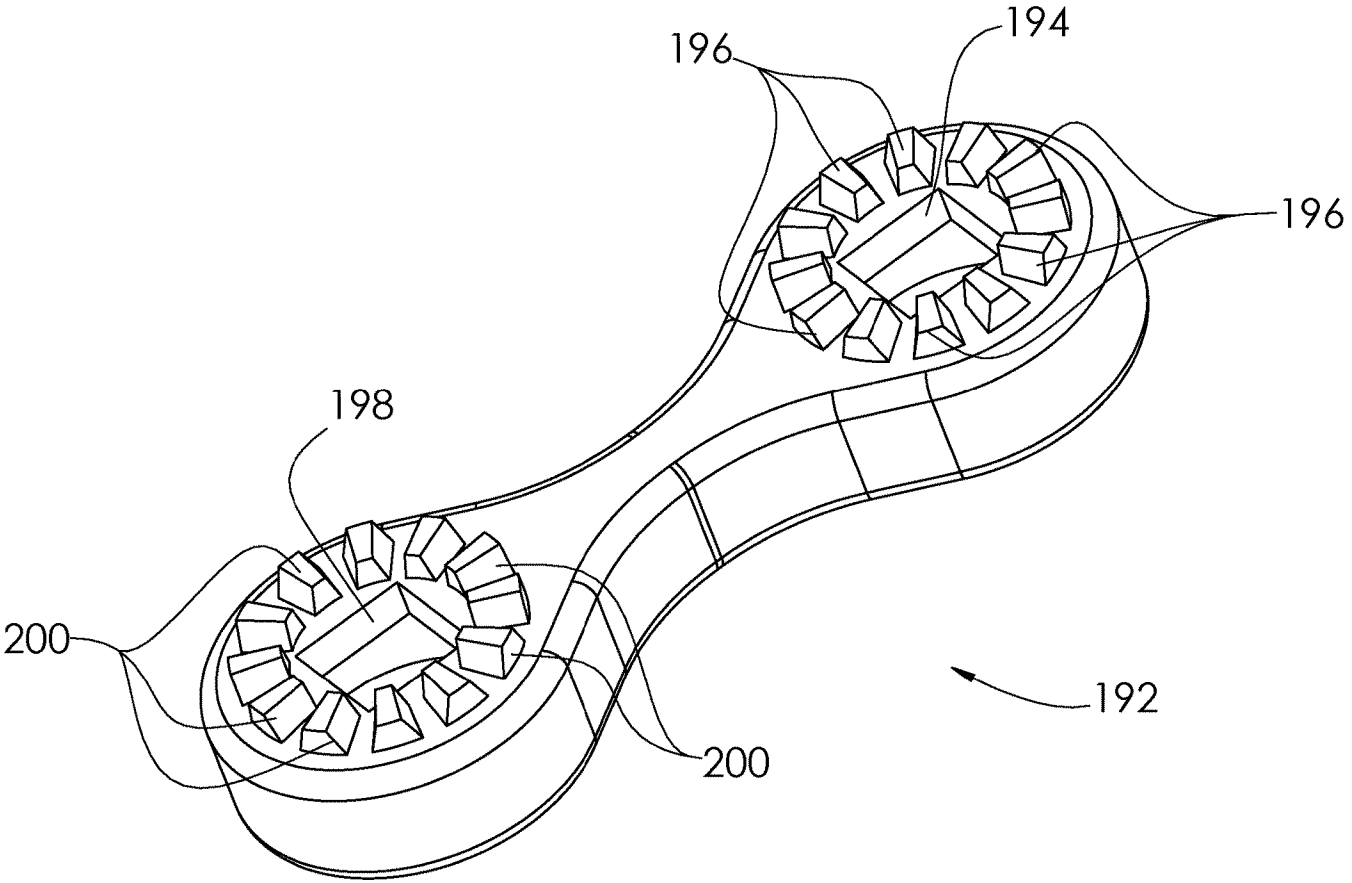
FIG. 18 is a perspective of the link from a rear side of the link.

In a second instance, the second handle 143 can be pivotably adjusted with respect to the link 192. The link has a hole 198 at its end opposite the location of hole 194 that is surrounded by locking teeth 200 (see, FIG. 18). The second handle 143 has a hole 152 that is surrounded on one side by locking teeth 156. These interconnectable locking structures permit the second handle 143 to be selectively positioned with respect to the link 192. A fastener assembly 148A is received through the holes 198, 152 of the link 192 and second handle 143 to pull the locking teeth 200, 156 together to prevent relative rotation of the second handle and the link. When attached to the link 192 and sufficiently locked in place by the fastener assembly 148A, the second handle 143 allows for the user to transfer motion into the second blade 124 of the shears 120. The fastener assembly 148A permits the second handle 143 to be loosened so that the locking teeth 200, 156 disengaged (see, FIG. 12) to permit the second handle to be re-positioned with respect to the link. Selected positions of the second handle 143 with respect to the link 192 are illustrated in FIG. 11. It is envisioned that links (not shown) of different sizes and shapes could be provided and interchanged as desired by the use to provide additional flexibility in configuring the shears. Moreover, more than one link 192 could be used.

The fastener assemblies 148, 148A illustrated for the second embodiment are identical to the fastener assembly 48 of the first embodiment. Accordingly one of the fastener assemblies 148 has been given the same reference numeral, plus "100," and the second fastener assembly has been designated 148A. Further details of the fastener assemblies 148, 148A of the second embodiment will not be provided, reference being made to the discussion of the fastener assembly of the first embodiment shown in FIG. 8.

The second handle 143 is a detachable piece that includes a mounting tab 144 and a loop portion 147. In the illustrated embodiment, the second handle 143 is made of 440C stainless steel, although other materials may be used. The loop portion 147 and opening 202 in the loop portion can be any suitable shape. For example, the opening could be more rectangular, triangular, or circular in shape. More than one configuration of second handle 143 could be provided, and second handles of different configurations could be selectively interchanged by the user. For example, a kit could be provided including the second handle 42 of the first embodiment, the second handle 143 of the second embodiment, and potentially other second handles (not shown).

Having described the invention in detail, it will be apparent that modifications and variations are possible without departing from the scope of the invention defined in the appended claims.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above products without departing from the scope of the invention, it is intended that all matter contained in the above description and shown in the accompanying drawings shall be interpreted as illustrative and not in a limiting sense.

What is claimed is:

1. Adjustable shears comprising a first blade, a second blade pivotally connected to the first blade for pivoting movement of the blades about a first axis to accomplish a cutting motion of the blades, the shears having an open position in which the first and second blades are spaced apart and a closed position in which the first and second blades are closest together, a first handle connected to the first blade and a second handle connected to the second blade, the second blade including a cutting portion and an extension portion extending from the first axis toward the first handle in the closed position of the shears, a link formed separately from the second handle and second blade is configured to connect the second handle to the second blade and space the second handle from the second blade, the second handle being configured for connection by the link to the second blade in a plurality of distinct positions with respect to the second blade, at least some of the distinct positions being separated angularly from each other about a second axis parallel to the first axis, wherein the second handle is configured for connection to the link in a plurality of distinct positions with respect to the link, at least some of the distinct positions of the second handle with respect to the link being separated angularly from each other about a third axis parallel to the first axis and the second axis, wherein at least one of the link and the second blade is formed with a locking structure for fixing the link and second blade in a selected one of the distinct positions about the second axis, and at least one of the link and the second handle being formed with a locking structure for fixing the second handle and link in a selected one of the plurality of distinct positions about the third axis.

2. Adjustable shears as set forth in claim 1 wherein the second handle is open thereby permitting a thumb or finger to be moved away from the second handle in a plane perpendicular to an axis of the pivoting movement of the blades.

3. Adjustable shears as set forth in claim 2 wherein the second handle includes a curved portion for receiving the thumb or finger therein.

4. Adjustable shears as set forth in claim 1 wherein the second handle defines a closed loop sized and shaped to receive and surround at least one of a thumb and a finger.

5. Adjustable shears as set forth in claim 1 further comprising at least one other second handle, each second handle being configured for connection and release to the second blade and for adjustable positioning with respect to the second blade.

6. Adjustable shears as set forth in claim 1 wherein the link is configured for connection to the second blade and to the second handle to permit an adjustment of a distance between the second handle and the second axis.

* * * * *